US008845130B2

(12) United States Patent
Gingrich, III

(10) Patent No.: US 8,845,130 B2
(45) Date of Patent: Sep. 30, 2014

(54) LED SOCKET ASSEMBLY

(75) Inventor: Charles Raymond Gingrich, III, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 571 days.

(21) Appl. No.: 12/634,453

(22) Filed: Dec. 9, 2009

(65) Prior Publication Data

US 2011/0136390 A1 Jun. 9, 2011

(51) Int. Cl.
*F21V 17/16* (2006.01)

(52) U.S. Cl.
USPC ... 362/249.02; 257/99; 362/800; 362/249.04; 362/249.14

(58) Field of Classification Search
USPC ..... 257/88, 81; 362/249.02, 249.04, 362/249.14; 439/110, 716
See application file for complete search history.

(56) References Cited

U.S. PATENT DOCUMENTS

| | | | |
|---|---|---|---|
| 5,038,255 | A | 8/1991 | Nishihashi et al. |
| 5,283,716 | A | 2/1994 | Banitt et al. |
| 5,404,282 | A | 4/1995 | Klinke et al. |
| 5,660,461 | A | 8/1997 | Ignatius et al. |
| 6,318,886 | B1 | 11/2001 | Stopa et al. |
| 6,541,800 | B2 | 4/2003 | Barnett et al. |
| 6,667,544 | B1 | 12/2003 | Glenn |
| 6,817,735 | B2 | 11/2004 | Shimizu et al. |
| 6,911,731 | B2 | 6/2005 | Wu |
| 6,999,318 | B2 | 2/2006 | Newby |
| 7,306,353 | B2 | 12/2007 | Popovich et al. |
| 7,322,718 | B2 | 1/2008 | Setomoto et al. |
| 7,348,604 | B2 | 3/2008 | Matheson |
| 7,400,029 | B2 | 7/2008 | Shimada et al. |

(Continued)

FOREIGN PATENT DOCUMENTS

| | | |
|---|---|---|
| DE | 19818402 | 10/1999 |
| DE | 10319525 | 11/2004 |

(Continued)

OTHER PUBLICATIONS

International Search Report, International Application No. PCT/US2010/003079, International Filing Date Feb. 12, 2010.

*Primary Examiner* — Sharon Payne

(57) ABSTRACT

A socket assembly includes sockets ganged together to form a pod with each of the sockets comprising a socket housing having a first end and a second end. The socket housing has a receptacle and a power track routed along the socket housing between the first and second ends. The power track has a positive rail and a negative rail. The sockets also comprises an anode on the socket housing at the receptacle being electrically connected to the positive rail and a cathode on the socket housing at the receptacle being electrically connected to the negative rail. The power tracks of adjacent sockets within the pod are electrically connected together to form a power circuit. Light emitting diode (LED) packages are received in corresponding receptacles of the sockets, and each LED package has a first contact and a second contact configured to be coupled to the anode and cathode, respectively, when the LED package is received in the corresponding receptacle. Each LED package has a base and an LED mounted to the base and being electrically connected to the first and second contacts. Optionally, the anode may be electrically connected to the positive rail via at least one of the other sockets. The cathode may be electrically connected to the negative rail via at least one of the other sockets.

23 Claims, 9 Drawing Sheets

(56) References Cited

U.S. PATENT DOCUMENTS

| | | | | |
|---|---|---|---|---|
| 7,540,761 | B2 | 6/2009 | Weber et al. | |
| 7,549,786 | B2 | 6/2009 | Higley et al. | |
| 7,553,162 | B2 | 6/2009 | Isoda et al. | |
| 7,862,203 | B2 * | 1/2011 | Tu et al. | 362/244 |
| 8,637,882 | B2 * | 1/2014 | Stoyan | 257/98 |
| 2002/0113244 | A1 | 8/2002 | Barnett et al. | |
| 2002/0114155 | A1 | 8/2002 | Katogi et al. | |
| 2002/0176250 | A1 | 11/2002 | Bohler et al. | |
| 2003/0063463 | A1 | 4/2003 | Sloan et al. | |
| 2003/0094893 | A1 | 5/2003 | Ellens et al. | |
| 2003/0112627 | A1 | 6/2003 | Deese | |
| 2003/0189829 | A1 | 10/2003 | Shimizu et al. | |
| 2004/0175189 | A1 | 9/2004 | Weber-Rabsilber et al. | |
| 2004/0252501 | A1 | 12/2004 | Moriyama et al. | |
| 2004/0264195 | A1 | 12/2004 | Chang et al. | |
| 2005/0152146 | A1 | 7/2005 | Owen et al. | |
| 2005/0243558 | A1 | 11/2005 | Van Duyn | |
| 2006/0091410 | A1 | 5/2006 | Chen | |
| 2006/0262533 | A1 | 11/2006 | Lin et al. | |
| 2007/0025103 | A1 | 2/2007 | Chan | |
| 2007/0246712 | A1 | 10/2007 | Kim et al. | |
| 2008/0220631 | A1 | 9/2008 | Isoda et al. | |
| 2008/0315214 | A1 | 12/2008 | Wall, Jr. et al. | |
| 2009/0009103 | A1 | 1/2009 | McKechnie et al. | |
| 2009/0009998 | A1 | 1/2009 | Malstrom et al. | |
| 2009/0108281 | A1 | 4/2009 | Keller et al. | |
| 2009/0130889 | A1 | 5/2009 | Daily et al. | |
| 2009/0146919 | A1 | 6/2009 | Kline et al. | |

FOREIGN PATENT DOCUMENTS

| | | |
|---|---|---|
| EP | 1098135 | 5/2001 |
| EP | 1 901 406 | 3/2008 |
| WO | WO 0173844 | 10/2001 |

* cited by examiner

LED SOCKET ASSEMBLY

CROSS REFERENCE TO RELATED APPLICATIONS

This Application Relates to U.S. patent application Ser. No. 12/634,416 titled SOLID STATE LIGHTING ASSEMBLY, U.S. patent application Ser. No. 12/634,492 titled SOLID STATE LIGHTING SYSTEM, U.S. patent application Ser. No. 12/634,517 titled LED SOCKET ASSEMBLY, and U.S. patent application Ser. No. 12/634,542 titled SOCKET ASSEMBLY WITH A THERMAL MANAGEMENT STRUCTURE, each filed concurrently herewith, the subject matter of each of which are herein incorporated by reference in their entirety.

BACKGROUND OF THE INVENTION

The subject matter herein relates generally to solid state lighting assemblies, and more particularly, to LED socket assemblies.

Solid-state light lighting systems use solid state light sources, such as light emitting diodes (LEDs), and are being used to replace other lighting systems that use other types of light sources, such as incandescent or fluorescent lamps. The solid-state light sources offer advantages over the lamps, such as rapid turn-on, rapid cycling (on-off-on) times, long useful life span, low power consumption, narrow emitted light bandwidths that eliminate the need for color filters to provide desired colors, and so on.

Solid-state lighting systems typically include different components that are assembled together to complete the final system. For example, the system typically consists of a driver, a controller, a light source, optics and a power supply. It is not uncommon for a customer assembling a lighting system to have to go to many different suppliers for each of the individual components, and then assemble the different components, from different manufacturers together. Purchasing the various components from different sources proves to make integration into a functioning system difficult. This non-integrated approach does not allow the ability to effectively package the final lighting system in a lighting fixture efficiently.

A need remains for a lighting system that may be efficiently packaged into a lighting fixture. A need remains for a lighting system that may be efficiently configured for an end use application.

BRIEF DESCRIPTION OF THE INVENTION

In one embodiment, a socket assembly is provided that includes sockets ganged together to form a pod with each of the sockets comprising a socket housing having a first end and a second end. The socket housing has a receptacle and a power track routed along the socket housing between the first and second ends. The power track has a positive rail and a negative rail. The sockets also comprises an anode on the socket housing at the receptacle being electrically connected to the positive rail and a cathode on the socket housing at the receptacle being electrically connected to the negative rail. The power tracks of adjacent sockets within the pod are electrically connected together to form a power circuit. Light emitting diode (LED) packages are received in corresponding receptacles of the sockets, and each LED package has a first contact and a second contact configured to be coupled to the anode and cathode, respectively, when the LED package is received in the corresponding receptacle. Each LED package has a base and an LED mounted to the base and being electrically connected to the first and second contacts. Optionally, the anode may be electrically connected to the positive rail via at least one of the other sockets. The cathode may be electrically connected to the negative rail via at least one of the other sockets.

In another embodiment, a socket assembly is provided including LED packages each having a first contact and a second contact, and each having a base and an LED mounted to the base that is electrically connected to the first and second contacts. The socket assembly also includes a plurality of sockets each comprising a socket housing having a receptacle positioned between a first end and a second end that receives a corresponding LED package. The socket housing has a first mating interface at the first end and a second mating interface at the second end. The sockets also include an anode on the socket housing at the receptacle being electrically connected to the first mating interface, and a cathode on the socket housing at the receptacle being electrically connected to second mating interface. The sockets are ganged together end-to-end to form a pod. The pod has one of the sockets defining a front end socket, one of the sockets defining a back end socket, and at least one interior socket flanked by the front end socket and the back end socket. The interior socket(s) are coupled to the second mating interface of the front end socket and are coupled to the first mating interface of the back end socket.

In a further embodiment, a socket assembly is provided that includes an LED package having a base with opposite ends and opposite sides. A first contact is arranged on one of the ends and one of the sides and a second contact is arranged on the other end and the other side. The LED package has an LED mounted to the base that is electrically connected to the first and second contacts. The socket assembly also includes a socket comprising a socket housing having opposite ends and opposite sides. The socket housing has a receptacle receiving the LED package. The socket also includes side contacts positioned proximate to the sides of the socket housing and end contacts positioned proximate to the ends of the socket housing. The first and second contacts are connected to corresponding side contacts and end contacts to create a power flow path through the socket. Each of the side contacts has an inner side contact exposed within the receptacle and an outer side contact coupled to the inner side contact by a removable tab. Each of the end contacts has an inner end contact exposed within the receptacle and an outer end contact coupled to the inner end contact by a removable tab. Two of the removable tabs are removed to create one of an end-to-end path, a side-to-side path or an end-to-side path for the power flow through the socket.

DETAILED DESCRIPTION OF THE INVENTION

Figure 1:
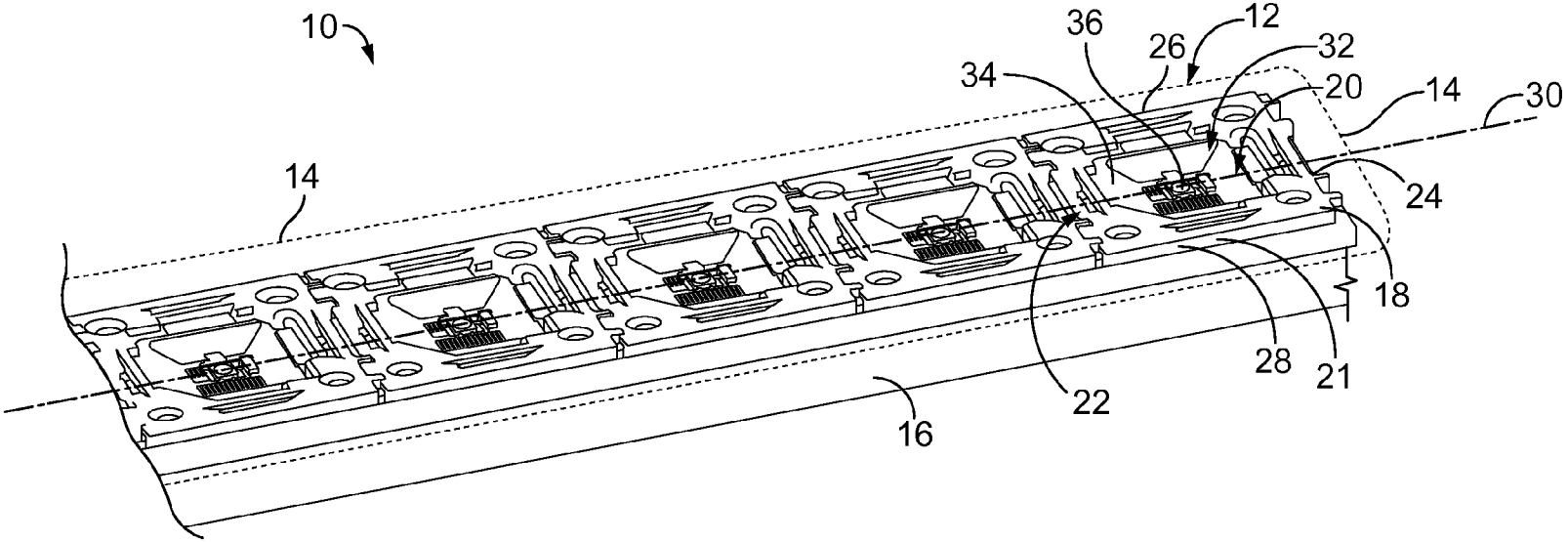
FIG. 1 is a top perspective view of an LED socket assembly formed in accordance with an exemplary embodiment.

FIG. 1 is a top perspective view of a light emitting diode (LED) socket assembly 10 formed in accordance with an exemplary embodiment. The assembly 10 forms part of a lighting fixture, such as a light engine that is used for residential, commercial or industrial use. The assembly 10 may be used for general purpose lighting, or alternatively, may have a customized application or end use.

The assembly 10 includes a plurality of sockets 12 ganged together to form one or more pods 14. The pods 14 are defined as a group of sockets 12 mechanically and electrically connected to one another to create a power circuit. Each pod 14 may include any number of sockets 12 arranged end-to-end. The sockets 12 are physically connected to one another to form a rigid structure. The sockets 12 are also electrically connected to one another to form a daisy-chained configuration in which power is passed from one socket 12 to the next within a given pod 14 and/or from one pod 14 to the next.

The sockets 12, and corresponding pods 14, are arranged adjacent one another on a base 16. In an exemplary embodiment, the base 16 constitutes a heat sink, and may be referred to hereinafter as heat sink 16. The sockets 12 may be physically coupled to the heat sink 16, such as using fasteners (not shown), or by integrating mounting features into the sockets 12 and heat sink 16.

Each socket 12 includes a socket housing 18 and an LED package 20 received in the socket housing 18. The socket housing 18 includes a dielectric body 21 having an outer perimeter with opposed ends 22, 24 and opposed sides 26, 28 extending between the ends 22, 24. The socket housings 18 are arranged end-to-end along a longitudinal axis 30. The sides 26, 28 are oriented parallel to the longitudinal axis 30 and the ends 22, 24 are oriented perpendicular to the longitudinal axis 30. In an exemplary embodiment, the outer perimeter is generally box-shaped, however the outer perimeter may have a different shape in alternative embodiments.

The socket housing 18 includes a receptacle 32 that receives the LED package 20. The LED package 20 has a base 34 and at least one LED 36 mounted to the base 34. The base 34 may be in thermal contact with the heat sink 16 such that the heat sink 16 may dissipate heat generated by the LED 36 and transferred through the base 34.

Figure 2:
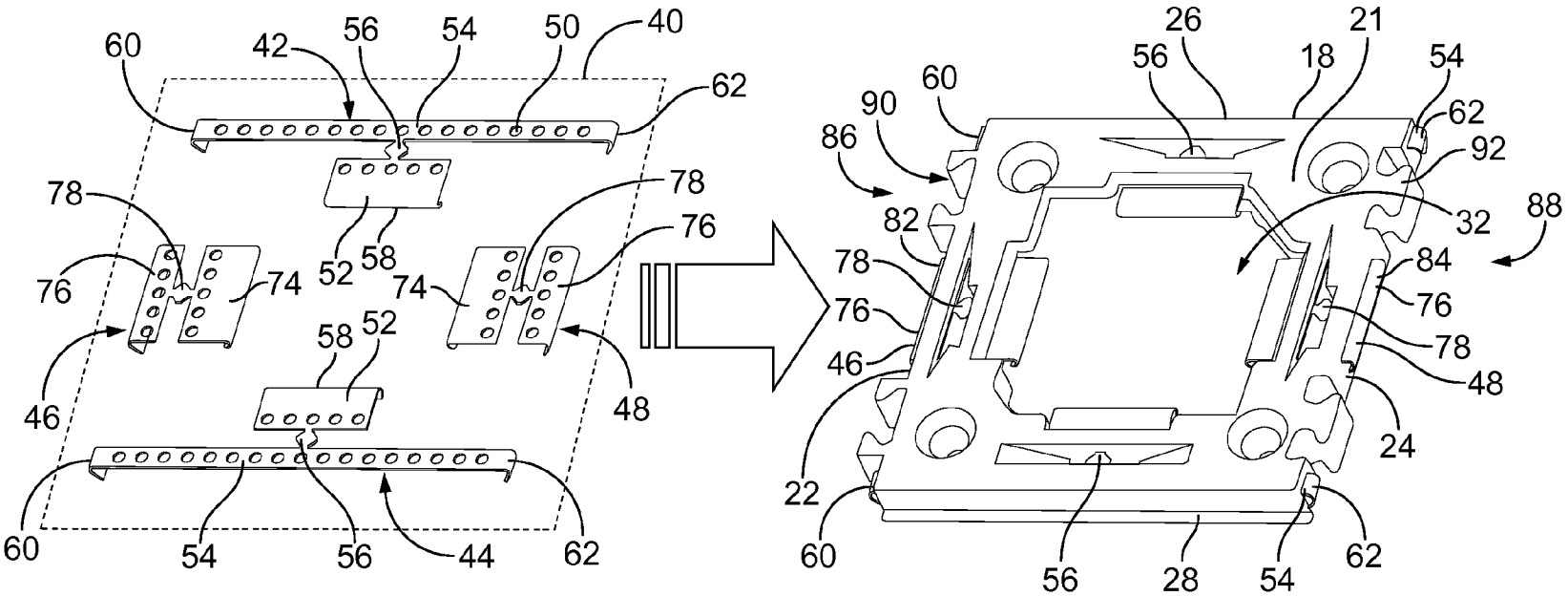
FIG. 2 illustrates a socket for the assembly shown in FIG. 1 and a power track for the socket shown separately.

FIG. 2 illustrates the socket housing 18 of the socket 12 (shown in FIG. 1) with the LED package 20 (shown in FIG. 1) removed. FIG. 2 also illustrates a power track 40 for the socket 12 shown separately from the dielectric body 21 for clarity.

The power track 40 forms part of the socket housing 18 when manufactured. The power track 40 forms the electrical conductive portion of the socket housing 18 for transferring the power through the socket 12 and to the LED package 20. In an exemplary embodiment, the power track 40 is embedded within the dielectric body 21 during manufacturing. For example, the power track 40 may be overmolded by the dielectric body 21 during a molding process. As such, the dielectric body 21 encases portions of the power track 40, while other portions of the power track 40 remain exposed, such as to interface with the LED package 20. The power track 40 may be held by the dielectric body in a different manner in an alternative embodiment. For example, the various components of the power track 40 may be received in slots formed in the dielectric body 21 after the dielectric body 21 is formed. Alternatively, the power track 40 may be formed on surfaces of the dielectric body 21, such as by a plating process. Optionally, the dielectric body 21 may be manufactured in multiple molding processes, with a plating process occurring between different molding processes.

In an exemplary embodiment, the power track 40 includes first and second side contacts 42, 44 positioned proximate to the sides 26, 28 of the socket housing 18. The power track 40 also includes end contacts 46, 48 positioned proximate to the ends 22, 24 of the socket housing 18. None of the contacts 42, 44, 46, 48 physically touch one another. The dielectric body 21 separates the contacts 42, 44, 46, 48. The dielectric body 21 holds the relative positions of the contacts 42, 44, 46, 48 once overmolded. In an exemplary embodiment, the contacts 42, 44, 46, 48 includes openings 50 therethrough, the dielectric body 21 being molded into the openings 50 during the overmolding process to securely retain the contacts 42, 44, 46, 48 within the dielectric body 21.

Each side contact 42, 44 includes an inner side contact 52 and an outer side contact 54 coupled to the inner side contact 52 by a removable tab 56. The inner side contacts 52 are exposed within the receptacle 32, such as for mating with the LED package 20. The inner side contacts 52 include mating interfaces 58 that face one another. Optionally, the mating interfaces 58 have a curved profile forming a spring beam. The mating interfaces 58 are cantilevered into the receptacle 32. The outer side contacts 54 each include first mating ends 60 and second mating ends 62 opposite the first mating ends 60. The outer side contacts 54 represent a rail, and may be referred to hereinafter as rail 54, configured to bus power between the ends 60, 62, and between adjacent sockets 12 when mated together. The rails 54 may be positive rails if connected to a positive lead of a power source or negative rails if connected to a negative lead of a power source. Optionally, the mating ends 60, 62 have curved profiles forming spring beams. The mating ends 60, 62 are cantilevered from the ends 22, 24, respectively, of the socket housing 18 when the dielectric body 21 is overmolded over the outer side contacts 54.

Each end contact 46, 48 has an inner end contact 74 and an outer end contact 76 coupled to the inner end contact 74 by a removable tab 78. The inner end contacts 74 are exposed within the receptacle 32, such as for mating with the LED package 20. The inner end contacts 74 include mating interfaces 80 that face one another. Optionally, the mating interfaces 80 have a curved profile forming a spring beam. The mating interfaces 80 are cantilevered into the receptacle 32. The outer end contacts 74 define a first mating end 82 and second mating end 84 opposite the first mating end 82. Optionally, the mating ends 82, 84 have curved profiles forming spring beams. The mating ends 82, 84 are cantilevered from the ends 22, 24, respectively, of the socket housing 18 when the dielectric body 21 is overmolded over the outer end contacts 76.

In the illustrated embodiment, the removable tabs 56, 78 are diamond shaped having a reduced width proximate the corresponding contacts 52, 54, 74, 76. The removable tabs 56, 78 may be sheared off, punched out, or otherwise removed to allow power to flow along a controlled power flow path between corresponding contacts 52, 54, 74, 76, depending on the particular application and desired power circuit. As such, the removable tabs 56, 78 provide circuit flexibility within the sockets 12, as will be described in further detail below. In an exemplary embodiment, and as will be described in further detail below, two of the removable tabs 56, 78 are removed and two of the removable tabs 56, 78 remain in place and physically joining the corresponding inner and outer contacts 52, 54 or 74, 76. The contacts 52, 54, 74 or 76 that remain define either an anode or a cathode for the socket 12, depending on the power flow path of the socket 12.

The socket housing 18 includes first and second mating interfaces 86, 88 at the opposed ends 22, 24, respectively. The second mating interface 88 is configured to mate with a first mating interface 86 of an adjacent socket 12 when assembled together end-to-end. The first mating interface 86 has latching features 90, represented in the illustrated embodiment by pockets. The second mating interface 88 has latching features 92, represented in the illustrated embodiment by protrusions having a complementary shape to the pockets. The latching features 90, 92 are configured to interconnect with one another, such as by the protrusions being securely received within the pockets. The mating ends 60, 82 of the side contacts 42, 44 and end contact 46, respectively, are exposed at the first mating interface 86. Similarly, the mating ends 62, 84 of the side contacts 42, 44 and end contact 48, respectively, are exposed at the second mating interface 88. The side contacts 42, 44 are configured to mate with side contacts 42, 44 of an adjacent socket 12 when assembled together end-to-end. Similarly, the end contact 48 is configured to mate with an end contact 46 of an adjacent socket 12 when assembled together end-to-end.

Figure 3:
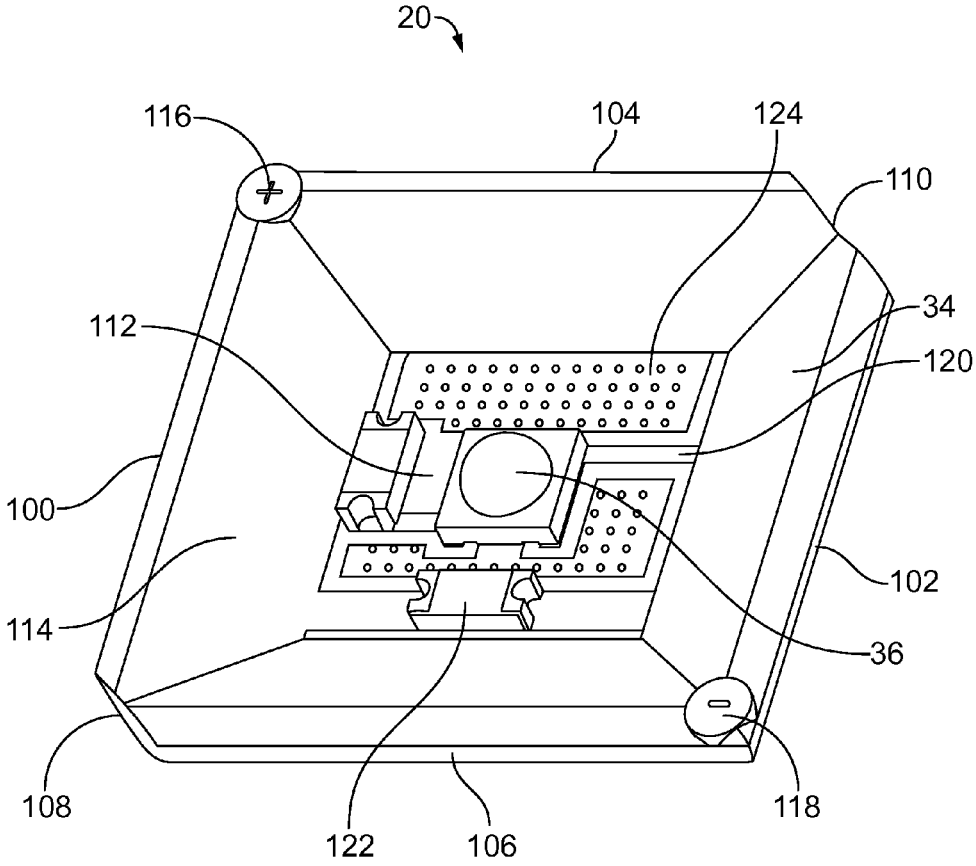
FIG. 3 is a top perspective view of an LED package for the assembly shown in FIG. 1.

FIG. 3 is a top perspective view of the LED package 20 showing the base 34 and a single LED 36 mounted to the base 34. Optionally, more than one LED 36 may be mounted to the base 34. The base 34 has opposite ends 100, 102 and opposite sides 104, 106 extending between the ends 100, 102. Optionally, the ends 100, 102 are perpendicular to the sides 104, 106. In an exemplary embodiment, one or more of the corners may be chamfered. For example, a first chamfered corner 108 is provided at the intersection of the end 100 and the side 106 and a second chamfered corner 110 is provided at the intersection of the end 102 and the side 104. The chamfered corners 108, 110 may be sized differently to define polarizing or keying features that orient the LED package 20 within the socket housing 18 (shown in FIG. 2).

The base 34 is manufactured from a dielectric material, such as a plastic material. Optionally, the base 34 may be manufactured from a material selected for having good thermal conductive properties, such as a thermally conductive polymer material. The base 34 has a recessed component mounting area 112, in which the LED 36 is mounted. The base 34 has angled walls 114 that extend from the mounting area 112 to the ends 100, 102 and the sides 104, 106. The walls 114 are angled at a predetermined angle so as to not interfere with the light cone produced by the LED 36. The base 34 has a reduced thickness at the mounting area 112 to allow better thermal transfer from the LED 36 to the bottom of the base 34.

The LED package 20 includes a first contact 116 and a second contact 118 configured for mating with the anode and cathode, respectively, of the socket 12. As such, the first contact 116 defines an anode contact, and may be referred to hereinafter as an anode contact 116. Similarly, the second contact 118 defines a cathode contact, and may be referred to hereinafter as a cathode contact 118. The first contact 116 extends along the first end 100 and the first side 104. The portion of the first contact 116 extending along the first side 104 is integral with, and thus electrically connected to, the portion extending along the first end 100. The second contact 118 extends along the second end 102 and the second side 106. The portion of the second contact 118 extending along the second side 106 is integral with, and thus electrically connected to, the portion extending along the second end 102. The first and second contacts 116, 118 are physically isolated from one another by the base 34.

The first and second contacts 116, 118 are connected to traces 120 on the mounting area 112. The LED 36 is mounted to the traces 120, and thus electrically connected to both the contacts 116, 118. In an exemplary embodiment, the LED package 20 may include other electrical components 122 connected to the traces 120, such as an over current switch, an over temperature switch, a circuit protection device, an electro static discharge protection device, and the like. The LED package 20 also includes heat spreaders 124. The LED 36 and/or the electrical components 122 are in thermal contact with the heat spreaders 124, which function to spread the heat across the mounting area 112. In an exemplary embodiment, the contacts 116, 118, the traces 120 and/or the heat spreaders 124 may be plated onto the base 34. Alternatively, the contacts 116, 118, the traces 120 and/or the heat spreaders 124 may be individual metal components coupled to the base 34, such as by adhesive, epoxy, solder, an interference fit, or some other securing process or manufacturing process.

Figure 4:
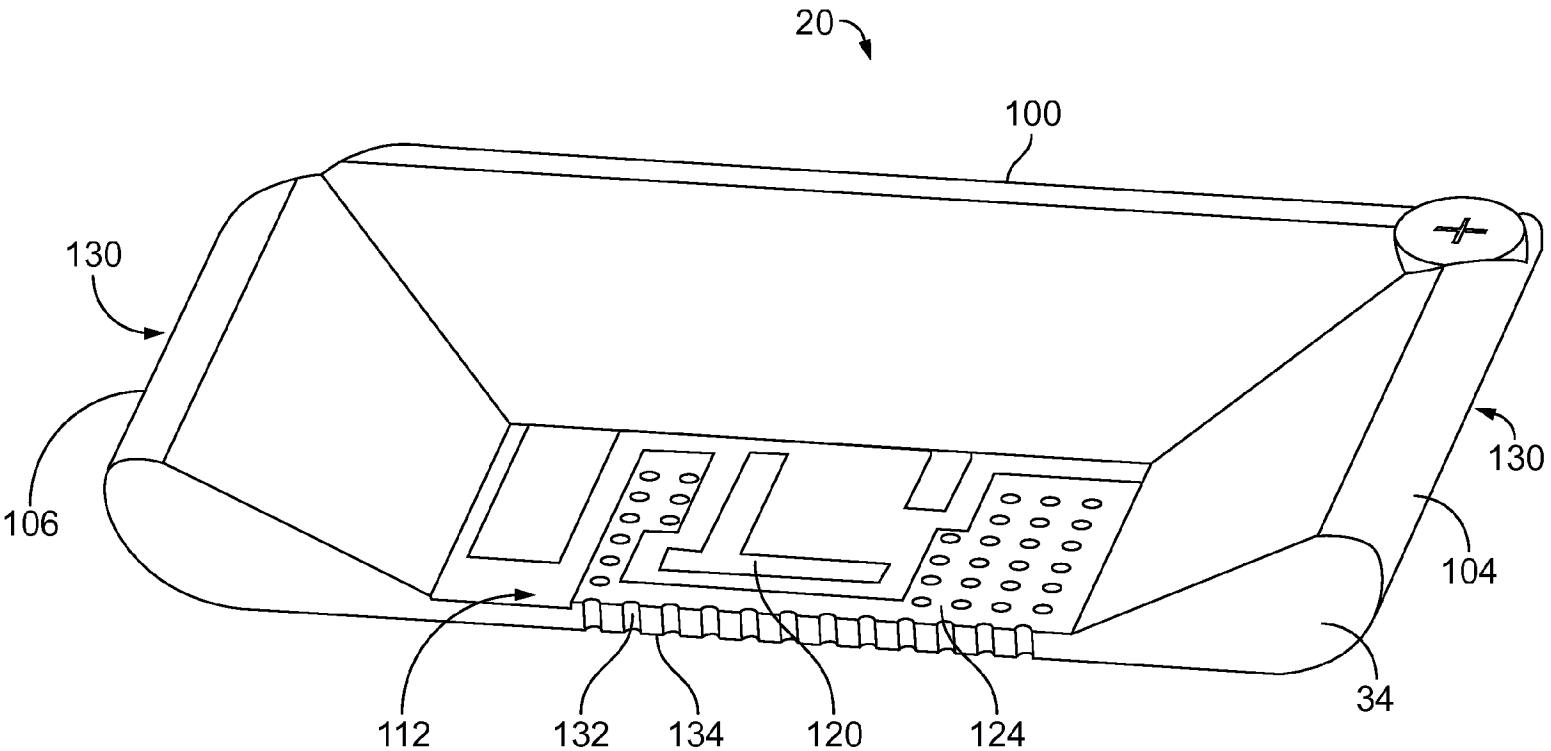
FIG. 4 is a cutaway view of the LED package shown in FIG. 3.

FIG. 4 is a cutaway view of the LED package 20 without the LED 36 or the components 122 (both shown in FIG. 3). The sides 104, 106 wrap at least partially around the outer edge of the base 34 to provide a mating interface 130 at both sides for mating with the side contacts 42, 44 (shown in FIG. 2). The end 100 includes a similar mating interface. The traces 120 and heat spreaders 124 are provided on a top surface of the mounting area 112. In an exemplary embodiment, the heat spreaders 124 have a plurality of plated thru holes 132 that extend to a bottom 134 of the base 34. The bottom 134 is also plated to define a bottom heat spreader covering at least a portion of the bottom 134. The bottom heat spreader is configured to interface with the heat sink 16 (shown in FIG. 1), either directly or through a thermal adhesive, thermal epoxy, a thermal grease, thermal pad, and the like. The thickness of the base 34 in the mounting area 112 is relatively thin to allow for efficient thermal transfer between the heat spreaders 124 and the bottom heat spreader.

Figure 5:
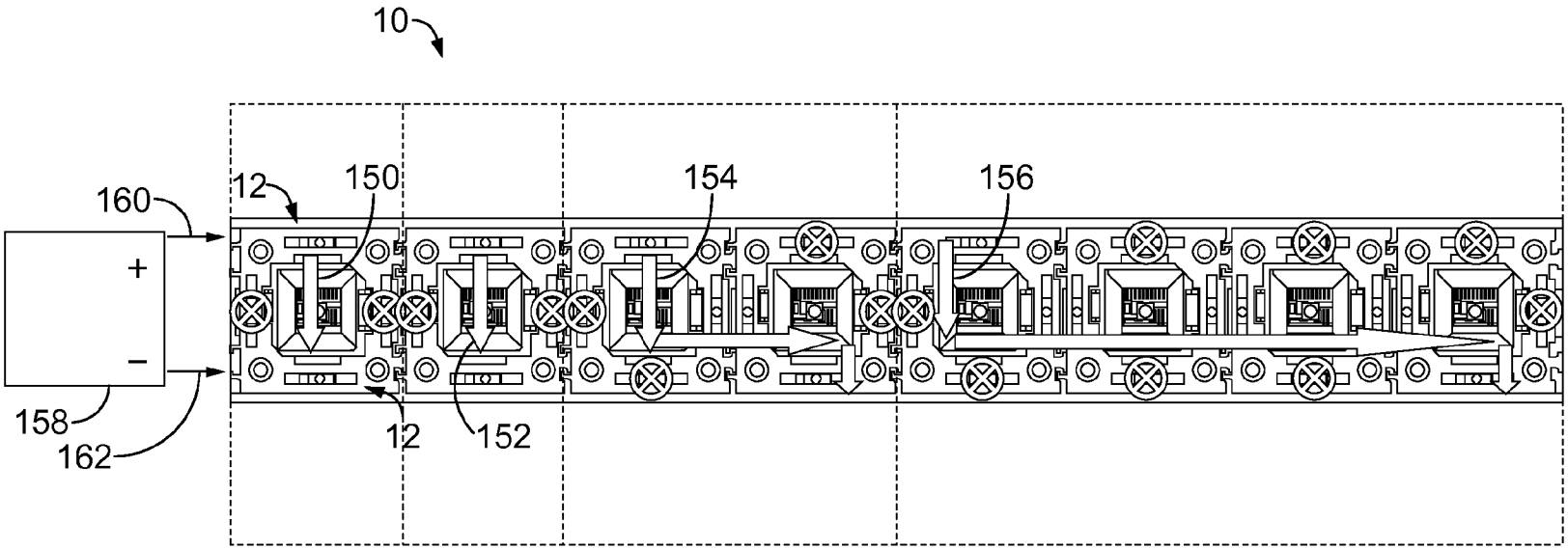
FIG. 5 is a bottom view of the assembly shown in FIG. 1 illustrating the power circuits for the assembly.

FIG. 5 is a top view of the assembly 10 illustrating power circuits 150, 152, 154, 156 formed by the assembly 10. The assembly 10 includes a driver 158 outputting power to the sockets 12. The driver 158 has a positive lead 160 and a negative lead 162, which are connected to the power track 40 of the sockets 12. For example, the leads 160, 162 are configured to be connected to the rails 54 at the upstream end of the assembly 10. The power flows downstream to the successive sockets 12 according to a desired power scheme. The sockets 12 are configurable to modify the power scheme as desired. The sockets 12 are electrically connected to one another to form a daisy-chained configuration in which power is passed from one socket 12 to the next according to the power scheme.

With reference back to FIGS. 2 and 3, which illustrate the various components of the socket housings 18 and LED packages 20, the following description of the power circuits 150, 152, 154, 156 will be better understood. Each of the sockets 12 are identical, and certain tabs 56, 78 are configured to be removed to define the power circuits 150, 152, 154, 156, as described in further detail below. The LED packages 20 are loaded into the socket housings 18. The first and second contacts 116, 118 of each LED package 20 engage, and are thus electrically connected to, the side contacts 42, 44 and the end contacts 46, 48. In the illustrated embodiment, the first contact 116 is connected to the first side contact 42 and the first end contact 46, while the second contact 118 is connected to the second side contact 44 and the second end contact 48.

The chamfered corners 108, 110 ensure that the LED packages 20 are loaded into the socket housings 18 in the proper orientation.

The sockets 12 are arranged end-to-end such that the sockets 12 are physically connected to one another to form a rigid structure. The mating interfaces 86, 88 of adjacent sockets 12 are mated with one another. The latching features 90, 92 physically secure the sockets 12 together. The rails 54 of adjacent sockets 12 engage one another and create a continuous track from the upstream end to the downstream end of the assembly 10. The end contacts 46, 48 of adjacent sockets 12 are mated together to create a potential electrical path between adjacent sockets 12.

In the illustrated embodiment, four different pods 14 are created, thus forming the four different power circuits 150, 152, 154, 156. The different power circuits 150, 152, 154, 156 are created by removing selected removable tabs 56 or 78 from the side contacts 42, 44 or the end contacts 46, 48, respectively. By removing certain tabs 56, 78, the flow path for the power through the socket 12 may be controlled to create one of an end-to-end path, a side-to-side path, a side-to-end path or an end-to-side path for the power flow through the socket 12.

In the illustrated embodiment, both the first and second power circuits 150, 152 represent side-to-side paths for the power flow through the sockets 12 where the power flows from the positive rail 54 (e.g. top rail) to the negative rail 54 (e.g. bottom rail). The power circuits 150, 152 are in parallel with one another and the corresponding sockets 12 are also in parallel with one another. The side-to-side paths are created by removing the removable tab 78 from the first end contact 46 and the removable tab 78 from the second end contact 48. Once the removable tabs 78 of the end contacts 46, 48 are removed, the inner and outer end contacts 74, 76 are no longer electrically connected together. As such, no flow path is provided between the inner and outer end contacts 74, 76 of either end contact 46, 48. The removable tabs 56 between the inner and outer side contacts 52, 54 remain in place and a flow path for the power is allowed therebetween. The first contact 116 of the LED package 20 is connected to the positive rail 54 via the engagement with the inner side contact 52. The second contact 118 of the LED package 20 is connected to the negative rail 54 via the engagement with the inner side contact 52.

The third and fourth power circuits 154, 156 both include multiple sockets 12 within each pod 14. The third power circuit 154 has two sockets 12 forming the pod 14 and the fourth power circuit 156 has four sockets forming the pod 14. Any number of sockets 12 may be provided within each pod 14. The power is passed from an upstream socket 12 to a downstream socket 12 by the sockets 12 being connected in series. Each of the pods 14 includes an upstream socket 170 at the upstream end of the pod 14 and a downstream socket 172 at a downstream end of the pod 14. The fourth pod also includes two interior sockets 174 between the upstream and downstream sockets 170, 172. The interior sockets 174 represent end-to-end paths for the power flow through the interior sockets 174 where the power flows from the first end 22 to the second end 24. The end-to-end paths are created by removing the removable tab 56 from the first side contact 42 and the removable tab 56 from the second side contact 44. Once the removable tabs 56 of the side contacts 42, 44 are removed, the inner and outer side contacts 52, 54 are no longer electrically connected together. As such, no flow path is provided between the inner and outer side contacts 52, 54. The removable tabs 78 between the inner and outer end contacts 74, 76 remain in place and a flow path for the power is allowed therebetween. The first contact 116 of the LED package 20 is connected to the first end contact 46. The second contact 118 of the LED package 20 is connected to the second end contact 48.

The upstream sockets 170 have side-to-end paths for the power flow therethrough, where the power flows from the positive rail 54 across the inner side contact 52 to the LED package 20, and then from the LED package 20 across the inner end contact 74 to the outer end contact 76. The side-to-end paths are created by removing the removable tab 78 from the first end contact 46 and the removable tab 56 from the second side contact 44. The removable tab 78 of the second end contact 48 and the removable tab 56 of the first side contact 42 remain in place and a flow path for the power is allowed therebetween. The first contact 116 of the LED package 20 is connected to the positive rail 54 via the engagement with the inner side contact 52. The second contact 118 of the LED package 20 is connected to the second end contact 48.

The downstream sockets 172 have end-to-side paths for the power flow therethrough, where the power flows from the first end contact 46, across the LED package 20, and then from the LED package 20 across the second side contact 44 to the negative rail 54. The end-to-side paths are created by removing the removable tab 78 from the second end contact 48 and the removable tab 56 from the first side contact 42. The removable tab 78 of the first end contact 46 and the removable tab 56 of the second side contact 44 remain in place and a flow path for the power is allowed therebetween. The first contact 116 of the LED package 20 is connected to the first end contact 46. The second contact 118 of the LED package 20 is connected to the negative rail 54 by the second inner side contact 52.

When assembled, the upstream sockets 170 take off power from the positive rail 54, and the downstream sockets 172 complete the circuit by connecting the power circuit to the negative rail 54. Any number of interior sockets 174 may be provided between the upstream and downstream sockets 174, transferring power downstream to the next socket 12.

Figure 6:
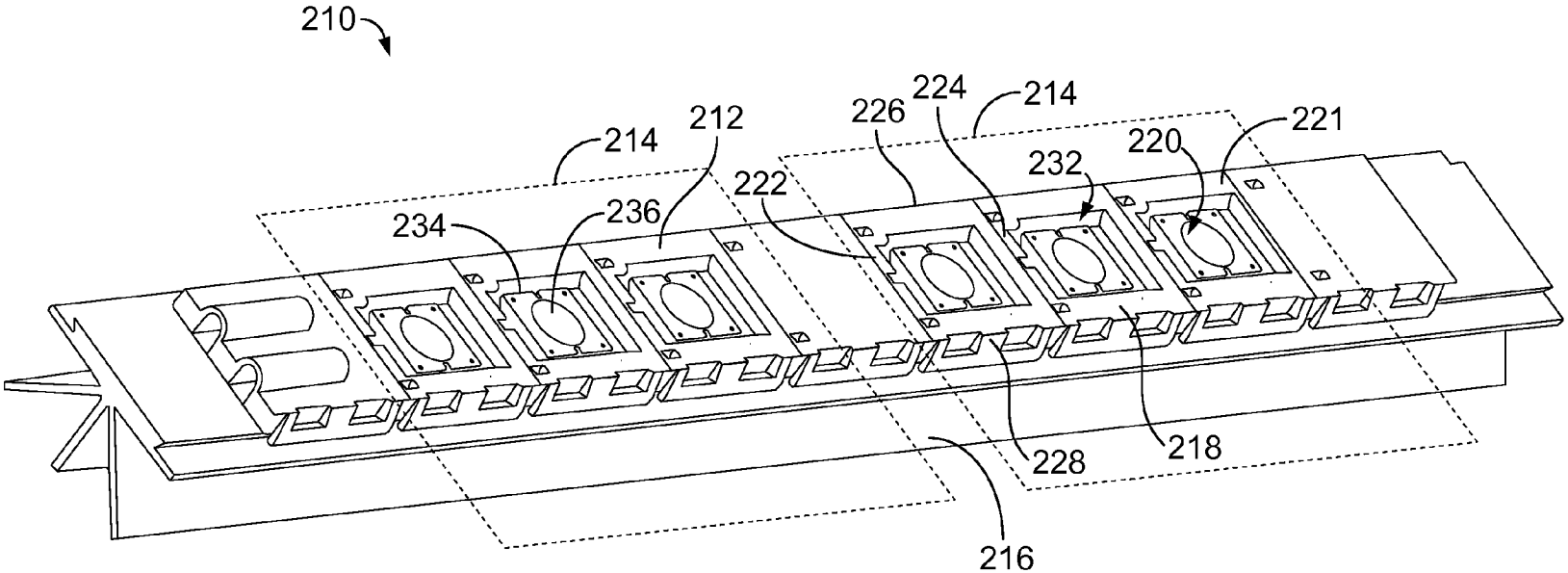
FIG. 6 is a top perspective view of an alternative LED socket assembly formed in accordance with an alternative embodiment.

FIG. 6 is a top perspective view of an alternative LED socket assembly 210 formed in accordance with an alternative embodiment. The assembly 210 forms part of a lighting fixture, such as a light engine that is used for residential, commercial or industrial use. The assembly 210 may be used for general purpose lighting, or alternatively, may have a customized application or end use.

The assembly 210 includes a plurality of sockets 212 ganged together to form one or more pods 214. The pods 214 are defined as a group of sockets 212 mechanically and electrically connected to one another to create a power circuit. Each pod 214 may include any number of sockets 212 arranged end-to-end. The sockets 212 are physically connected to one another to form a rigid structure. The sockets 212 are also electrically connected to one another to form a daisy-chained configuration in which power is passed from one socket 212 to the next within a given pod 214 and/or from one pod 214 to the next.

The sockets 212, and corresponding pods 214, are arranged adjacent one another on a base 216. In an exemplary embodiment, the base 216 constitutes a heat sink, and may be referred to hereinafter as heat sink 216. The sockets 212 may be physically coupled to the heat sink 216, such as using fasteners (not shown), or by integrating mounting features into the sockets 212 and heat sink 216.

Each socket 212 includes a socket housing 218 and an LED package 220 received in the socket housing 218. The socket housing 218 includes a dielectric body 221 having an outer perimeter with opposed ends 222, 224 and opposed sides 226, 228 extending between the ends 222, 224. The socket housing 218 includes a receptacle 232 that receives the LED package 220. The LED package 220 has a base 234 and at least one LED 236 mounted to the base 234. The base 234 may be in thermal contact with the heat sink 216.

Figure 8:
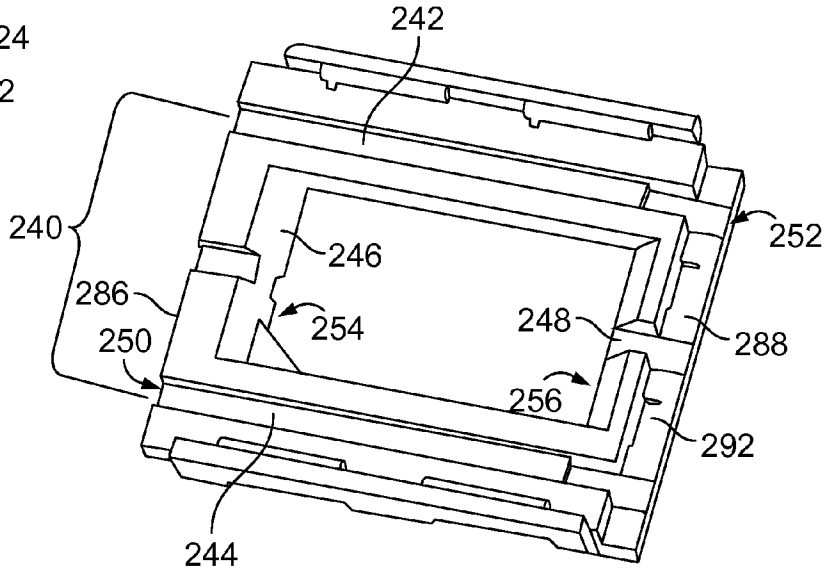
FIG. 8 is a bottom perspective view of the socket shown in FIG. 7.
Figure 7:
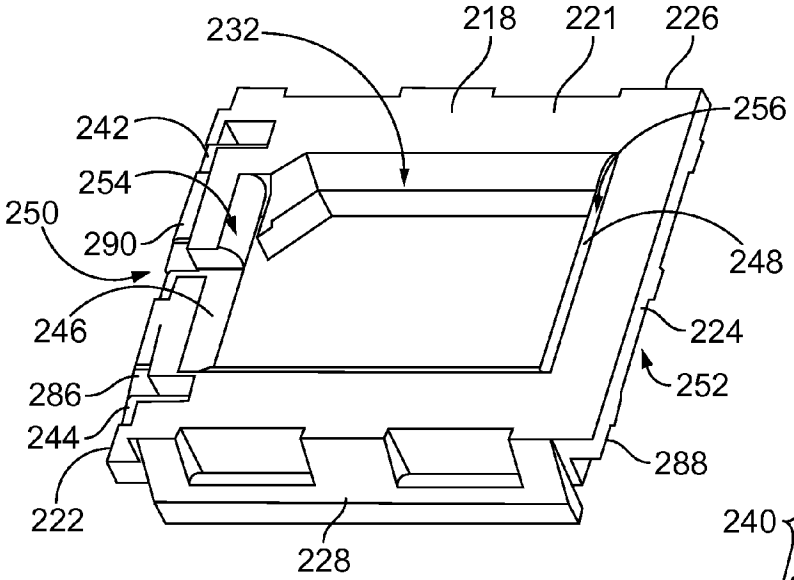
FIG. 7 is a top perspective view of a socket for the assembly shown in FIG. 6.

FIG. 7 is a top perspective view of the socket housing 218 with the LED package 220 (shown in FIG. 1) removed. FIG. 8 is a bottom perspective view of the socket housing 218 illustrating a power track 240 for the socket 212.

The power track 240 forms part of the socket housing 218 when manufactured. The power track 240 forms the electrically conductive portion of the socket housing 218 for transferring the power through the socket 212 and to the LED package 220. In an exemplary embodiment, the power track 240 is plated onto selected portions of the dielectric body 221. Portions of the power track 240 remain exposed, such as to interface with other track portions 240 of adjacent sockets and/or to interface with the LED package 220. The power track 240 may be held by the dielectric body 221 in a different manner in an alternative embodiment. For example, the various components of the power track 240 may be received in slots formed in the dielectric body 221 after the dielectric body 221 is formed. Alternatively, the power track 240 may be embedded within the dielectric body 221, such as during an overmolding process.

In an exemplary embodiment, the power track 240 includes a positive rail 242 and a negative rail 244 positioned proximate to the sides 226, 228 of the socket housing 218. The positive rail 242 is configured to be connected to a positive lead of a power source and the negative rail 244 is configured to be connected to a negative lead of a power source. The power track 240 also includes first and second contacts 246, 248 positioned proximate to the ends 222, 224 of the socket housing 218. The contacts 246, 248 having socket mating interfaces 250, 252, respectively, configured to mate with a corresponding power track 240 of an adjacent socket 12. The contacts 246, 248 also have package mating interfaces 254, 256 configured to mate with the LED package 220 (shown in FIG. 6).

The socket housing 218 includes housing mating interfaces 286, 288 at the opposed ends 222, 224, respectively. The second mating interface 288 is configured to mate with a first mating interface 286 of an adjacent socket 212 when assembled together end-to-end. The first mating interface 286 has latching features 290, represented in FIG. 7 by protrusions. The second mating interface 288 has latching features 292, represented in FIG. 8 by pockets having a complementary shape to the protrusions. The latching features 290, 292 are configured to interconnect with one another, such as by the protrusions being securely received within the pockets. The socket mating interfaces 250, 252 of the contacts 246, 248 are exposed at the housing mating interfaces 286, 288. Similarly, mating ends of the rails 242, 244 are exposed at the housing mating interfaces 286, 288. The contacts 246, 248 and rails 242, 244 are configured to mate with corresponding contacts and rails of an adjacent socket 212 when assembled together end-to-end.

Figure 9:
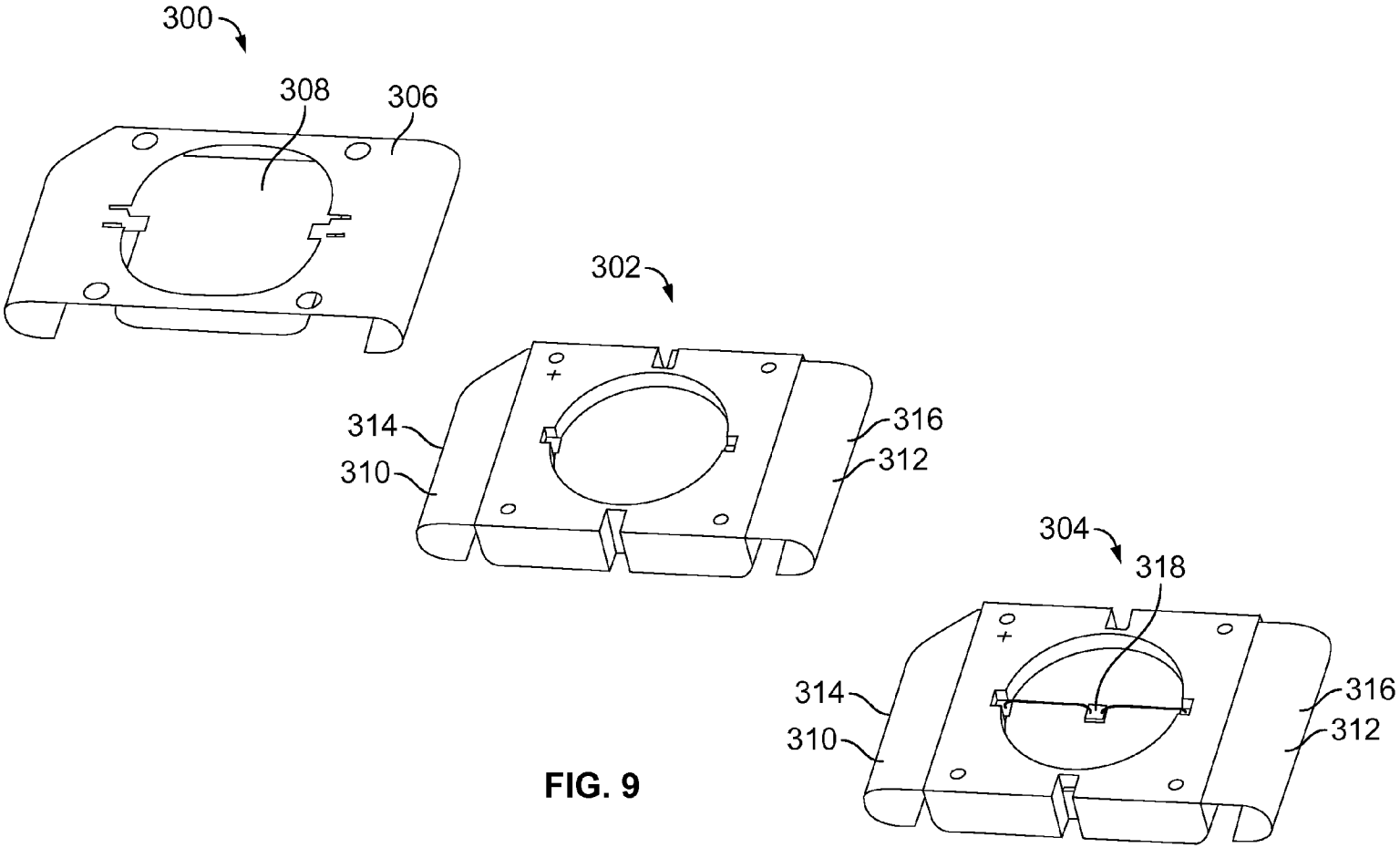
FIG. 9 illustrates a manufacturing process for an LED package for the assembly shown in FIG. 6.

FIG. 9 illustrates a manufacturing process for the LED package 220 showing the LED package 220 at three different stages of manufacture, an initial stage 300, an intermediate stage 302, and a final stage 304. In the initial stage 300, one or more contacts 306 are positioned proximate to a heat slug 308. In the intermediate stage 302, the base 234 is formed by molding a dielectric body over the contact(s) 306. In the illustrated embodiment, a single contact 306 is provided and overmolded. Once overmolded, thin portions of the contact 306 are exposed along both sides of the LED package 220. The thin portions are removed, such as by punching those portions out of the base 234 (as shown in the final stage 304). By punching out the thin portions, the contact is separated into two different contact portions defining an anode lead 310 and a cathode lead 312. The leads 310, 312 having mating interfaces 314, 316 that are configured to mate with the contacts 246, 248 (shown in FIGS. 7 and 8). In the final stage 304, the LED 236 is formed, such as by mounting a LED die 318 to the heat slug 308, wire bonding the LED die 318 to the leads 310, 312, and then applying a phosphor to the LED die 318.

Once manufactured, the LED package 220 may be loaded into the socket 212 (shown in FIGS. 7 and 8). The leads 310, 312 represent compliant beams that allow the LED package 220 to be loaded into the socket 212 without soldering the LED package 220 into the socket 212. Optionally, the LED package 220 may be assembled with the socket 212 by a pick and place assembly process so that the assembly may be automated. Additionally, the LED package 220 is removably coupled to the socket 212 such that the LED package 220 may be easily and efficiently removed and replaced. As such, if the LED 236 is defective, the LED package 220 may be removed and replaced with a different LED package 220.

Figure 10:
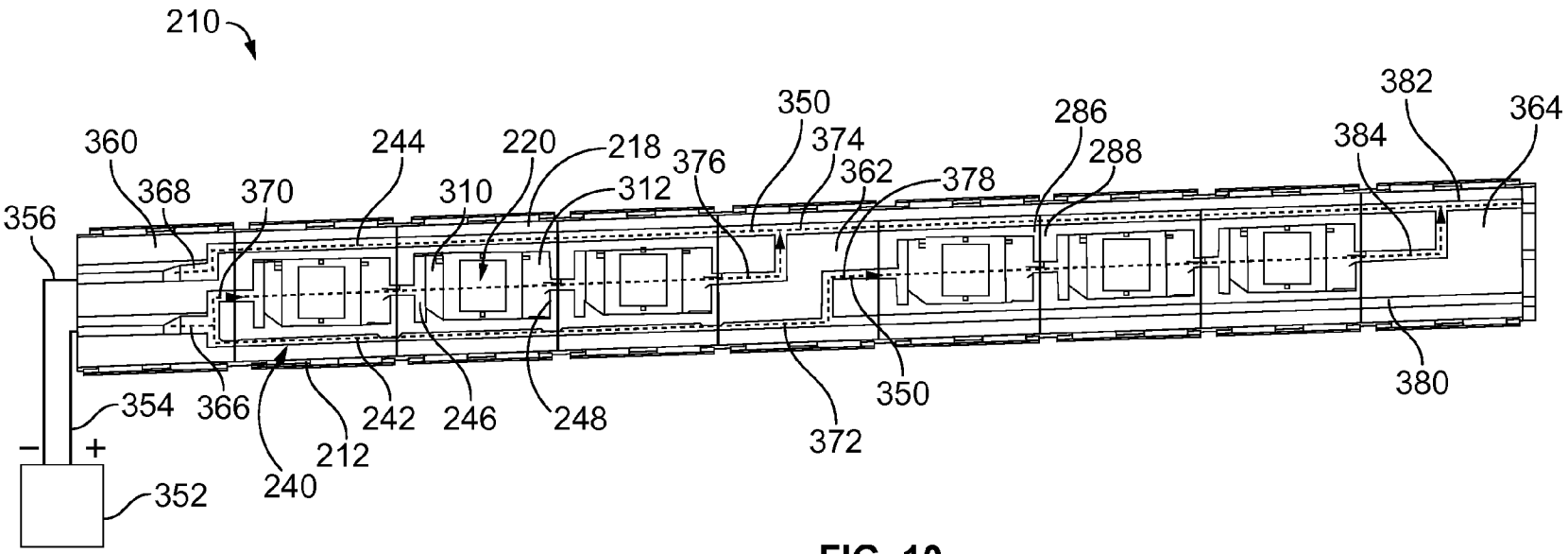
FIG. 10 is a bottom view of the assembly shown in FIG. 1 illustrating the power circuits for the assembly.

FIG. 10 is a bottom view of the assembly 210 illustrating various power circuits 350 for the assembly. The assembly 210 includes a driver 352 outputting power to the sockets 212. The driver 352 has a positive lead 354 and a negative lead 356, which are connected to the power track 240 of the sockets 212. For example, the leads 354, 356 are configured to be connected to the positive rail 242 and the negative rail 244 at the upstream end of the assembly 210.

The power flows downstream to the successive sockets 212 according to a desired power scheme. The sockets 212 are configurable to modify the power scheme as desired. The sockets 212 are electrically connected to one another to form a daisy-chained configuration in which power is passed from one socket 212 to the next according to the power scheme.

The LED packages 220 are loaded into the socket housings 218. The anode lead 310 and the cathode lead 312 of each LED package 20 engage, and are thus electrically connected to, the contacts 246, 248.

The sockets 212 are arranged end-to-end such that the sockets 212 are physically connected to one another to form a rigid structure. The mating interfaces 286, 288 of adjacent sockets 212 are mated with one another. The latching features 290, 292 (shown in FIGS. 7 and 8) physically secure the sockets 212 together. The rails 242, 244 of adjacent sockets 212 engage one another and create a continuous track from the upstream end to the downstream end of the assembly 210. The contacts 246, 248 of adjacent sockets 212 are mated together to create a potential electrical path between adjacent sockets 212.

In the illustrated embodiment, the assembly 210 includes a front end cap 360, a mid-section cap 362 and a back end cap 364. The front end cap 360 includes a connector for the positive and negative leads 354, 356. For example, the front end cap 360 includes poke-in wire type connections for the leads 354, 356. The front end cap 360 includes a positive rail 366 and a negative rail 368 configured to be connected to the corresponding rails 242, 244 of the sockets 212. The front end cap 360 includes a power take off 370 from the positive rail 366. The power take-off 370 is routed approximately to the center of the cap 360. The power take off 370 is configured to be connected to the first contact 246.

A series of sockets 212 representing a pod 214 are connected in series the front end cap 360 and the mid-section cap 362. The sockets 212 are mechanically and electrically connected together. Power flows from one socket 212 to the next.

Any number of sockets 212 may be provided between the front end cap 360 and the mid-section cap 362.

The mid-section cap 362 includes a positive rail 372 and a negative rail 374, connected to the corresponding rails 242, 244 of the sockets 212. The mid-section cap 362 includes a first power take-off 376 and a second power take-off 378. The first power take off 376 is electrically connected to the second contact 248 of the last socket 212 in the pod 214. The first power take off 376 is also electrically connected to the negative rail 374. The second power take off 378 is electrically connected to the first contact 246 of the first socket 212 in the downstream pod 214. The second power take off 378 is also electrically connected to the positive rail 372. The mid-section cap 362 is positionable between two pods 214 and is configured to connect each of the pods 214 to the corresponding rails 372 or 374.

The back end cap 364 includes a positive rail 380 and a negative rail 382 configured to be connected to the corresponding rails 242, 244 of the sockets 212. The back end cap 364 includes a power take off 384 connecting the negative rail 382 and the second contact 248 of the downstream socket 212 within the pod 214.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A socket assembly comprising:

sockets ganged together to form a pod, each of the sockets comprising a socket housing having a first end and a second end, the socket housing having a receptacle and a power track routed along the socket housing between the first and second ends, the power track having a positive rail and a negative rail, the positive and negative rails of the power track each having mating ends at the first and second ends, the mating ends having curved profiles forming spring beams that define deflectable interfaces configured to mate with corresponding adjacent sockets, the sockets comprising an anode on the socket housing at the receptacle being electrically connected to the positive rail and a cathode on the socket housing at the receptacle being electrically connected to the negative rail, wherein the sockets are ganged together such that the first end of one socket housing is directly connected to the second end of an adjacent socket housing to electrically connect the power tracks of adjacent sockets within the pod to form a power circuit; and light emitting diode (LED) packages received in corresponding receptacles of the sockets, each LED package having a first contact and a second contact configured to be coupled to the anode and cathode, respectively, when the LED package is received in the corresponding receptacle, each LED package having a base and an LED mounted to the base and being electrically connected to the first and second contacts.

2. The assembly of claim 1, wherein the anode and cathode are electrically connected to the positive rail and negative rail, respectively, via at least one of the other sockets.

3. The assembly of claim 1, wherein mating ends of the positive rail are exposed at the first end and the second end of the socket housing to interface with a corresponding positive rail of an adjacent socket, and wherein mating ends of the negative rail are exposed at the first end and the second end of the socket housing to interface with a corresponding negative rail of an adjacent socket.

4. The assembly of claim 1, further comprising a power take-off electrically coupling the positive rail with the anode and a power take-off electrically coupling the negative rail with the cathode.

5. The assembly of claim 1, wherein the positive rail of the power track is continuous along each of the sockets forming the pod, and wherein the negative rail of the power track is continuous along each of the sockets forming the pod.

6. The assembly of claim 1, wherein the first end has a first mating interface and the second end has a second mating interface, the first and second mating interfaces having latching features configured to interconnect with one another, wherein the spring beams at the mating ends are deflected and spring biased against the corresponding spring beams of the adjacent socket when the latching features are interconnected.

7. The assembly of claim 1, further comprising at least one positive rail loop creating a path between the positive rail and the corresponding anode and further comprising at least one negative rail loop creating a path between the negative rail and the corresponding cathode.

8. The assembly of claim 1, wherein the sockets are ganged together to form a first pod and a second pod, both the first and second pods having a path from the positive rail to the corresponding anode and from the negative rail to the corresponding cathode, the power track from the first rail providing a power circuit beyond the first pod to the second pod.

9. A socket assembly comprising:

light emitting diode (LED) packages each having a first contact and a second contact, each LED package having a base and an LED mounted to the base and being electrically connected to the first and second contacts; and a plurality of sockets each comprising:

a socket housing having a single receptacle approximately centered in the socket housing and positioned between a first end and a second end, the receptacle removably receiving a corresponding LED package and positioning the corresponding LED package approximately centered in the socket housing, the socket housing having a first mating interface at the first end and a second mating interface at the second end;

an anode on the socket housing at the receptacle being electrically connected to the first mating interface; and a cathode on the socket housing at the receptacle being electrically connected to second mating interface;

wherein the sockets are ganged together end-to-end to form a pod with the LED packages aligned in a single row, the pod having one of the sockets defining a front end socket, one of the sockets defining a back end socket, and at least one interior socket flanked by the front end socket and the back end socket, the at least one interior socket being coupled to the second mating interface of the front end socket, the at least one interior socket being coupled to the first mating interface of the back end socket.

10. The assembly of claim 9, wherein the anode and cathode are plated on the socket housing.

11. The assembly of claim 9, wherein the socket includes contacts at the first and second mating interfaces, the contacts being electrically connected to the anode and the cathode.

12. The assembly of claim 9, wherein the first and second mating interfaces have latching features configured to interconnect with one another, and wherein the first and second mating interfaces have contacts having mating ends configured to electrically interface with a corresponding mating interface of an adjacent socket, the mating ends having curved profiles forming spring beams that define deflectable interfaces that mate with corresponding spring beams of the adjacent socket.

13. The assembly of claim 9, wherein each socket housing includes a power track routed along the socket housing between the first and second ends, the power track having a positive rail and a negative rail, the anode being electrically connected to the positive rail and a cathode being electrically connected to the negative rail.

14. The assembly of claim 9, wherein the socket includes side contacts positioned proximate to the sides of the socket housing and end contacts positioned proximate to the ends of the socket housing, wherein each of the side contacts has an inner side contact exposed within the receptacle and an outer side contact coupled to the inner side contact by a removable tab and each of the end contacts has an inner end contact exposed within the receptacle and an outer end contact coupled to the inner end contact by a removable tab, wherein two of the removable tabs are removed to create one of an end-to-end path, a side-to-side path, a side-to-end path or an end-to-side path for power flow through the socket, the inner side or end contacts retaining the corresponding removable tab defining the anode and cathode.

15. A socket assembly comprising:

a light emitting diode (LED) package having a base with opposite ends and opposite sides, the LED package having a first contact arranged on one of the ends and one of the sides and a second contact arranged on the other end and the other side, the LED package having an LED mounted to the base and electrically connected to the first and second contacts; and a socket comprising a socket housing having opposite ends and opposite sides, the socket housing having a receptacle receiving the LED package, the socket also comprising side contacts positioned proximate to the sides of the socket housing and end contacts positioned proximate to the ends of the socket housing, the first and second contacts being connected to corresponding side contacts and end contacts to create a power flow path through the socket;

wherein each of the side contacts has an inner side contact exposed within the receptacle and an outer side contact coupled to the inner side contact by a removable tab and each of the end contacts has an inner end contact exposed within the receptacle and an outer end contact coupled to the inner end contact by a removable tab, wherein two of the removable tabs are removed to create one of an end-to-end path, a side-to-side path, a side-to-end path or an end-to-side path for the power flow through the socket.

16. The assembly of claim 15, wherein portions of the side and end contacts are overmolded by the socket housing embedding the side and end contacts within the socket housing, the removable tabs being exposed through access ports in the socket housing for removal after the socket housing is molded.

17. The assembly of claim 15, wherein the outer side contacts are exposed at the first end and the second end of the socket housing to interface with a corresponding outer side contact of an adjacent socket.

18. The assembly of claim 15, wherein the socket housing has a first mating interface at one end and a second mating interface at the other end, the outer end contacts being exposed at the corresponding first or second mating interface to interface with a corresponding outer end contact of an adjacent socket.

19. The assembly of claim 15, wherein the ends of the socket housing have mating interfaces with latching features configured to interconnect with complementary latching features of an adjacent socket to physically secure socket contacts end-to-end.

20. The assembly of claim 1, wherein the socket housing includes a rigid, dielectric body extending between the first and second ends, the dielectric body defining the receptacle.

21. The assembly of claim 1, wherein the sockets are ganged together to form the pod without the use of intervening, discrete connectors.

22. The assembly of claim 1, wherein at least one of the positive rail or the negative rail includes a stamped and formed body, the stamped and formed body being overmolded by a dielectric overmold forming the socket housing such that the stamped and formed body is embedded in the socket housing, the mating ends being exposed at the first and second ends.

23. The assembly of claim 1, wherein the positive and negative rails of the power track each having mating interfaces exposed in the receptacle, the mating interfaces having curved profiles forming spring beams that define deflectable interfaces, the deflectable interfaces defining the anode and the cathode and being configured to mate with the first and second contacts of the corresponding LED package.

* * * * *